US005453299A

United States Patent [19]

Hsu

[11] Patent Number: 5,453,299

[45] **Date of Patent: * Sep. 26, 1995**

[54] PROCESS FOR MAKING ELECTROLESS PLATED ARAMID SURFACES

[75] Inventor: Che-Hsiung Hsu, Wilmington, Del.

[73] Assignee: E. I. Du Pont de Nemours and Company, Wilmington, Del.

[ * ] Notice: The portion of the term of this patent subsequent to Apr. 12, 2011 has been disclaimed.

[21] Appl. No.: 261,074

[22] Filed: Jun. 16, 1994

[51] Int. Cl.[6] ..... B05D 1/18; B05D 3/10

[52] U.S. Cl. ..... 427/306; 427/304; 427/305; 427/316; 427/443.1

[58] Field of Search ..... 427/304, 305, 427/306, 316, 443.1

[56] References Cited

U.S. PATENT DOCUMENTS

| | | | |
|---|---|---|---|
| 3,620,804 | 11/1971 | Johnson et al. . | |
| 3,733,213 | 5/1973 | Jacob . | |
| 3,880,580 | 4/1975 | Horowitz | 427/304 |
| 4,335,164 | 6/1982 | Dillard | 427/306' |
| 4,349,421 | 9/1982 | Khattab . | |
| 4,552,787 | 11/1985 | Chebiniak et al. . | |
| 4,985,046 | 1/1991 | Hartzler . | |
| 5,160,600 | 11/1992 | Patel | 427/306 |
| 5,302,415 | 4/1994 | Gabara | 427/306 |

FOREIGN PATENT DOCUMENTS

| | | |
|---|---|---|
| 2820502 | 11/1979 | Germany . |

*Primary Examiner*—Roy V. King

[57] ABSTRACT

A process is disclosed for treating aramid fibers such that metal plating applied thereto is durable, highly conductive, and strongly adherent. The process involves contacting the fibers with an acid, neutralizing and washing the fibers with water, and then plating the fibers by an electroless plating process. The acid treatment of the fibers promotes adhesion between the metal and the fibers and promotes high electrical conductivity for the plated metal.

13 Claims, 1 Drawing Sheet

PROCESS FOR MAKING ELECTROLESS PLATED ARAMID SURFACES

BACKGROUND OF THE INVENTION

1. Field of the Invention

This invention relates to electroless metal plating of aramid fibers wherein the metal is strongly adhered to the aramid fiber substrate and provides a highly conductive surface. The aramid is subjected to a preplating treatment including carefully controlled exposure to a concentrated aqueous nitric acid solution or a dilute concentration of chlorosulfonic or fluorosulfonic acid in an organic liquid, followed by washing, catalyzation, and the electroless plating, itself.

2. Description of the Prior Art

Electroless plating is the deposition of a metal film by interaction of metal ions and a chemical reducing agent in a basic solution. Electroless plating, in a general way, is well known. One of the difficulties in achieving successful electroless plating has resided in obtaining good adhesion between the plating substrate and the plated metal. While mere encapsulation may suffice for some applications and some articles, good adhesion of the plated metal is essential for fiber surfaces because the plated metal coating must be durable enough to withstand the forces of further processing and end use stresses.

U.S. Pat. No. 5,302,415, issued Apr. 12, 1994 discloses a process for making electroless plated aramid surfaces by means of a preplating treatment using 80 to 90 weight percent aqueous sulfuric acid.

SUMMARY OF THE INVENTION

The present invention provides a process for plating aramid fibers at increased plating rates with a durable metal coating comprising the steps of; soaking aramid fibers with an acid solution of 86 to 91 weight percent aqueous nitric acid or 1 to 5 weight percent chlorosulfonic acid or fluorosulfonic acid in an organic liquid for at least 2 seconds at a temperature in the range from 10° to 100° C., neutralizing and washing the acid-soaked fibers with water until substantially all of the acid is removed, and plating the fibers by an electroless plating process.

For plating the fibers with copper, the electroless plating process can be conducted by contacting the acid-treated and washed fibers with a tin-palladium activation solution, rinsing the fibers in water to remove nonadherent activation metal, optionally, immersing the rinsed fibers in an aqueous accelerator solution of mineral acid and then immersing the fibers in an electroless copper plating bath.

In practice of the present invention, it is preferred that the activation solution include palladium for copper or nickel plating; and silver for silver plating.

DETAILED DESCRIPTION OF THE INVENTION

Figure 1:
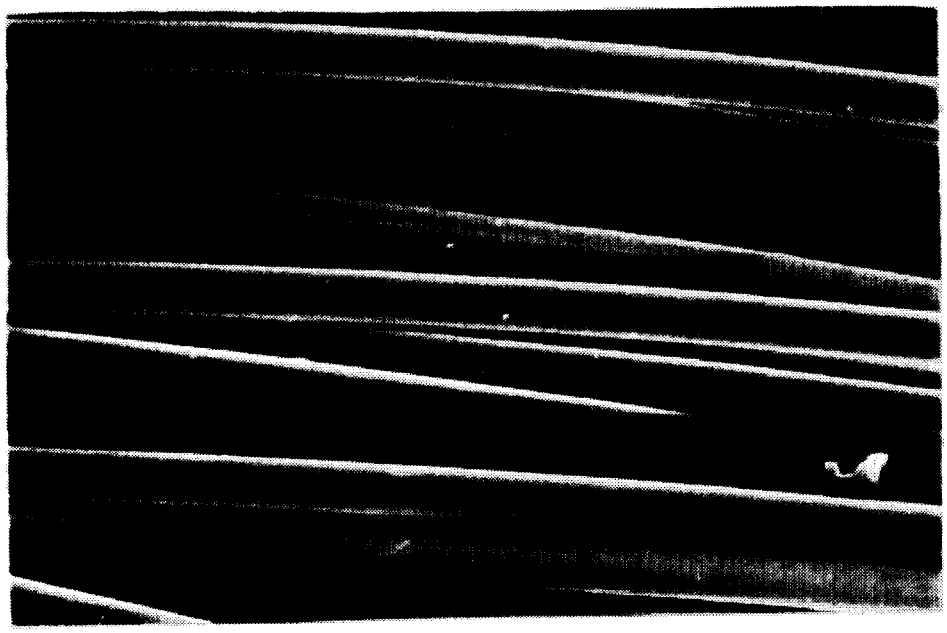
FIG. 1 is a photomicrograph, at ×500 magnification, of fibers inadequately treated for metal plating.

There has long been a need for conductive aramid fibers which have durable metallic coatings; and that need is especially acute for fibers which exhibit high strength and modulus.

Fibers of aramids have been difficult to plate with a durable metal coating. Aramid fiber surface treatments and pretreatments have, generally, not been entirely satisfactory.

This invention provides a process for electrolessly plating fibers of aramids at substantially increased plating rates and in a way that yields a plated fiber product of substantially maintained strength and modulus and a metal coating which is highly conductive and strongly adherent. The process can be conducted on a continuous basis or batch-wise.

By "aramid" is meant a polyamide wherein at least 85% of the amide (—CO—NH—) linkages are attached directly to two aromatic rings. Suitable aramid fibers are described in Man-Made Fibers - Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and, as a special case, it has been found that up to as much as 30 percent, by weight, of polyvinyl pyrrolidone can be included with poly(p-phenylene terephthalamide) in aramid fibers to be plated by the process of this invention.

Para-aramids are the primary polymers in fibers of this invention and poly(p-phenylene terephthalamide) (PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

Meta-aramids can also be used in the fibers of this invention and poly(m-phenylene isophthalamide) (MPD-I) is the preferred meta-aramid. By MPD-I is meant the homopolymer resulting from mole-for-mole polymerization of m-phenylene diamine and isophthaloyl chloride and, also, copolymers resulting from incorporation of small amounts of other diamines with the m-phenylene diamine and of small amounts of other diacid chlorides with the isophthaloyl chloride. As a general rule, other diamines and other diacid chlorides can be used in amounts up to as much as about 10 mole percent of the m-phenylene diamine or the isophthaloyl chloride, or perhaps slightly higher, provided only that the other diamines and diacid chlorides have no reactive groups which interfere with the polymerization reaction. MPD-I, also, means copolymers resulting from incorporation of other aromatic diamines and other aromatic diacid chlorides, provided, only that the other aromatic diamines and aromatic diacid chlorides be present in amounts which do not interfere with the desired performance characteristics of the aramid.

Aramid fibers made by wet or air-gap spinning processes of the previously-mentioned patents are coagulated into a so-called "never-dried" form wherein the fiber includes considerably more than 75 weight percent water. The "never-dried" fibers are then dried to less than about 20 weight percent water in order to collapse the polymer structure of the fiber. Fibers eligible for use in the process of the present invention are dried fibers having a moisture content of less than 20 weight percent. Generally the fibers used in the process of the present invention will be even more dry, having a moisture content of about 3.5 to 7% water.

As a first step in the process of this invention, the aramid fibers to be plated are contacted with a pretreatment acid. The pretreatment acid used in practice of this invention is aqueous nitric acid or chloro- or fluorosulfonic acid in an organic liquid unreactive with the acid. It has been determined that neither aqueous hydrochloric acid, nor aqueous phosphoric acid will yield acceptable results when used as the pretreatment acid; and it has been determined that chloro- and fluorosulfonic acids decompose in water and must be used in a nonaqueous liquid.

The pretreatment of the present invention can be accomplished using aqueous nitric acid of concentration from about 86 weight percent up to the concentration where there is excessive damage to the materials being treated, about 91 weight percent. The acid concentration limits are, of course, affected by temperature and duration of the pretreatment. The pretreatment is generally conducted at the ambient temperature—normally 20° to 40° C.—and for a moderate duration—normally 5 to 60 seconds. If the temperature or the duration of the pretreatment is increased, the acid concentration can be, accordingly, reduced. At increased temperature or increased duration, nitric acid of less than 86 weight percent may be effective; and at decreased temperatures or decreased duration, nitric acid of greater than 86 weight percent can be used. When acid of too low concentration is used, the pretreatment is ineffective in yielding high plated metal adhesion and when acid of too high concentration is used, the treated fibers are excessively damaged.

The chlorosulfonic acid and the fluorosulfonic acid are used in relatively dilute concentrations in an organic liquid for the pretreatment of this invention. The organic liquids which are eligible for use include any in which the acids are miscible and with which the acids do not react. Examples of such liquids include methylene chloride, hexane, cyclohexane, and the like. The concentration for these halosulfonic acids for the pretreatment of this invention should be from about 1 weight percent up to the concentration where there is excessive damage to the materials being treated, about 5 weight percent. Pretreatment conditions using these halosulfonic acids are generally the same as those for aqueous nitric acid.

Pretreatment of aramid fibers using the acids described above at the prescribed concentrations, times, and temperatures yields a remarkably rapid metal pick-up rate as will be shown in the Examples which follow. While the reason for such rapid pick-up rate is not completely understood, it is clear that treatment with nitric acid at concentrations from 86–91% at a temperature of 30° C. and treatment with chloro- or fluorosulfonic acid at concentrations from 1–5% at a temperature of 30° C. results in metal pick-up by aramid fibers which is dramatically increased.

The temperature of the acid pretreatment bath should be in the range from 10° to 100° C. and preferably about 20° C. to 40° C. The upper temperature limit is governed by the adverse effect on fiber tensile properties and filament fusion while the lower temperature limit is a matter of practicality;—lower temperatures requiring unacceptably long times for adequate treatment.

The fibers, which can be of any desired thickness, are contacted with the acid for at least 2 seconds. With shorter exposure times it is difficult, ultimately, to achieve satisfactory depth of treatment. Longer exposure sometimes produces excessive cracking of the filaments and causes loss of tensile properties. As a general rule, contacting fibers with the acid for more than 120 seconds, even at moderate temperatures, results in degradation of the fibers. The preferred contact time is about 15–40 seconds. Exposure time to the acid can be reduced by increasing the temperature and/or increasing the acid concentration. Effective practice of the process of this invention requires a reasonable combination of acid concentration, temperature and soaking time.

Figure 2:
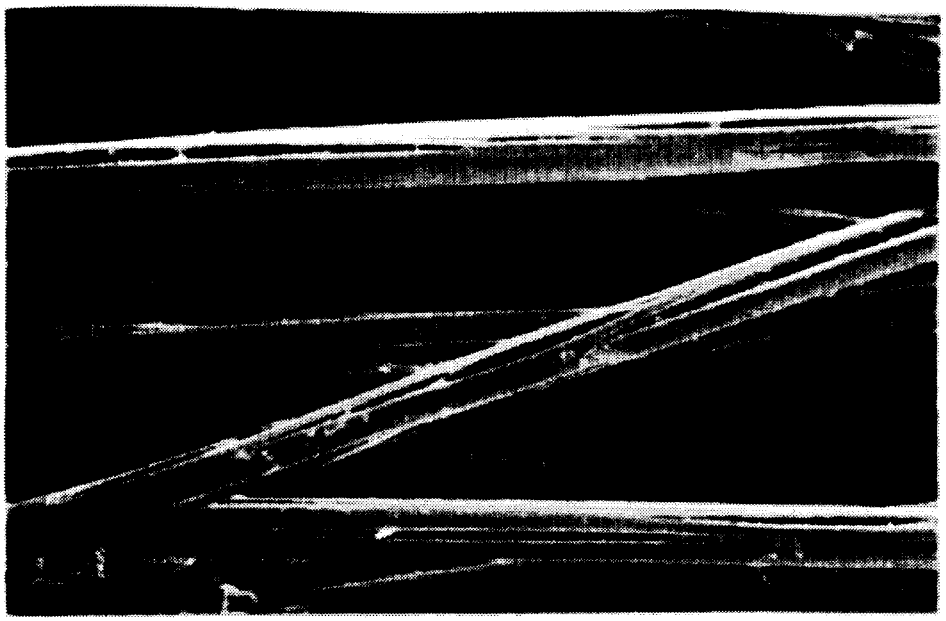
FIG. 2 is a photomicrograph, at ×500 magnification, of fibers treated in accordance with the present invention.

The acid soaking step of the process of this invention causes the surface of the fibers to be etched and causes morphological changes and microscopic cracks to be formed through the fiber surface. Referring to the figures, FIG. 1 is a photomicrograph of PPD-T fibers which have been immersed in 85 weight percent nitric acid for 20 seconds at about 20° C.; and FIG. 2 is a photomicrograph of PPD-T fibers which have been immersed in 90 weight percent nitric acid for 5 seconds at about 20° C. The fibers in FIG. 1 are smooth and apparently unchanged by the treatment while the fibers in FIG. 2 are cracked and split irregularly along their length. The treatment shown in FIG. 1 is inadequate to yield the strongly adherent metal coating of the present invention; and the treatment shown in FIG. 2 yields the desired metal adhesion.

One important aspect of the present invention resides in the fact that the pretreatment utilizes acids at conditions which actually alter the structure of the fibers in order to achieve the desired plated metal adhesion. Although the alteration is held to a tolerable level, the pretreatment must alter the fibers to achieve the desired result.

The acid-contacted PPD-T fibers are washed well with water to remove substantially all of the pretreatment acid. Optionally, the fiber can be neutralized with a base such as sodium bicarbonate solution which can be added to the wash water or used in a separate step. It is, also, possible to dry the acid-treated fibers prior to the plating step.

The kernel of this invention resides in the discovery that aramid fibers treated with acid as prescribed herein, can yield an improved metal-plated fiber product. As a general rule, well-known electroless metal plating processes can be used to plate the aramid fibers after acid treatment in accordance with the present invention.

For an example of a copper plating process, an aqueous activation solution is prepared using palladium and tin cations as activation catalyst. The acid-contacted and washed PPD-T fibers to be plated are immersed in the solution and agitated to promote activation of the fiber surfaces. The fibers are, then, if desired, removed from the activation solution and rinsed and may, if desired, be transferred to an accelerator bath of dilute mineral acid.

The fibers are then placed in, or conducted through, a plating bath with copper ions and formaldehyde wherein the copper ions are complexed to keep them in solution, for example, with tetrasodium salt of ethylenediamine tetraacetic acid (EDTA).

Baths having a wide range of metal concentrations can be used in practice of this invention. The preferred plating baths are from about 1 to 5 grams per liter of copper. In tests described herein, baths of 1 to 3 grams per liter of copper are most preferred.

The plating bath, with immersed fibers, is moderately agitated for 10 to 20 minutes to assure adequate pick-up. Formaldehyde, pH-adjusting caustic solution, and copper ion solution are added at the rate of depletion. Additions can be made continuously or intermittently. The plated material can then be rinsed and dried. Instead of formaldehyde, other materials can be used as reducing agents. Among the eligible reducing agents are hypophosphite, hydrazine, boron hydride, and the like.

All of the above steps can be conducted with the various baths at temperatures of 10° to 60° C., and preferably 20°–40° C.

For an example of a silver plating process, the acid-contacted fibers are first immersed in an aqueous reducing agent solution such as $SnCl_2$/HCl. The $SnCl_2$/HCl-immersed fibers are rinsed with water extensively to remove excess and non-adherent stannous ions and are then transferred to an aqueous bath to which is added a metal complex solution of silver nitrate and ammonia at a bath pH of 8–9.5. During immersion in the metal complex bath, the bath is agitated to ensure that imbibed stannous ions reduce silver ions to silver to preferentially deposit on the silver-activated polymer surface. In a typical process, the molar ratio of formaldehyde/silver is from 1.1/1 to 2/1. The amount of silver nitrate is adjusted to provide the desired weight of reduced silver as a function of the fiber material to be plated. The silver-plated fibers are rinsed and dried.

Instead of silver or copper, nickel or cobalt or the like can be, also, plated on the acid-contacted fibers with a proper combination of activation solution, reducing agent solution, and a metal plating solution.

The plating processes can be conducted on acid-contacted fibers which have been dried or which remain wet from the acid-contacting step. In the case of copper plating, the plating quality appears to be relatively unaffected by drying the fibers after acid contact. However, the silver plating process appears to yield plated silver of the lowest resistance when the fibers, first, are dried at about 15°–80° C., preferably at 15°–20° C. When the fibers to be silver plated are dried at moderate temperature, there appears to be less silver metal impregnated into the fiber structure, than there is with undried fibers, and there appears to be better continuity of silver coating than is realized with fibers dried at higher temperatures.

TEST METHODS

Electrical Resistance

A resistance cell is constructed by mounting one-inch long copper electrodes parallel and one inch apart on a flat block of nonconductor such as polyethylene. The electrodes are connected to an ohmmeter such as a Keithley 173A multimeter and the resistance of a fabric is determined by pressing the cell against the fabric positioned on a flat, nonconductive, surface. Resistance is reported as ohms per square.

DESCRIPTION OF THE PREFERRED EMBODIMENTS

Preparation of Plated Fibers

The following procedure was used for plating fibers in the Examples below: The fibers to be plated were either first treated with the pretreatment acid and then knitted into small fabric tubings or first knitted and then treated with the pretreatment acid. Of course, fibers for comparative examples were not subjected to the acid pretreatment or were treated with acid outside of the concentration ranges or treatment conditions required by this invention. The knitting machine was sold by Scott & Williams, Laconia, N.H., U.S.A., under the name KOMET and had a 3.5 inch (8.89 centimeter) diameter head; and the fabric consisted of six courses (stitches parallel with the tubing axis) and five wales (stitches perpendicular with the tubing axis).

Each of the knitted fabric samples was then conducted through a copper electroless plating process using commercially available chemistries as follows:

(a) contacting the fabrics for about 10 minutes at about 40° C. with an aqueous activation solution of mineral acid, stannous chloride, and palladium, for example, a solution of 60 milliliters of Shipley Co. "Cataposit" 44, an aqueous tin or sodium chloride solution; and, for example, a solution of 540 grams of Shipley Co. "Cataprep" 404 in 1700 milliliters of water, to provide a palladium-tin complex for activating the fiber surfaces;

(b) rinsing the yarns for about 5 minutes in two changes of water at about 25° C.;

(c) immersing the yarns for about 20 minutes at about 40° C. in an aqueous plating bath containing, for example, 240 milliliters of Shipley Co. "Circuposit" 3350M; 84 milliliters of Shipley Co. "Circuposit" 3350A; 200 millimeters of Shipley Co. "Circuposit" 3350B; and 1,476 milliliters water.

(d) rinsing the yarns for about 7 minutes in two changes of water at about 25° C.; and (e) drying the yarns overnight in a vacuum oven at about 20° C.

For the purpose of these examples, the plated fibers were analyzed for copper metal to determine the amount of copper picked up during the plating process.

EXAMPLE 1 AND COMPARATIVE EXAMPLES 1–4

The effect of nitric acid as a pretreatment acid was investigated in these examples. The fibers which were treated in these examples were in the form of an aramid yarn of 400 denier having 1.5 denier per filament (445 dtex having 1.7 dtex per filament) made from poly(p-phenylene terephthalamide) and sold by E. I. du Pont de Nemours and Company under the trademark "KEVLAR" 29.

Yarns of the fibers were pretreated by immersion in nitric acid at about 20° C. and at concentrations and for durations indicated in Table 1; and were then thoroughly rinsed by water and immersed in an 8 weight percent sodium bicarbonate solution for 5 minutes before rinsing in water, again, for one and one-half hours. The pretreated yarns were air-dried and knitted into tubes and plated in accordance with the aforedescribed procedure.

TABLE 1

(Effect of Nitric Acid Pretreatment on Plating)

| | Conc. (W. %) | Duration* (Sec.) | Copper pickup (W %) | Elec. Res. (ohm/sq) | Comments |
|---|---|---|---|---|---|
| Comparative 1 | 70 | 60 | 23.3 | $>3 \times 10^8$ | Copper particles in all three rinse waters |
| Comparative 2 | 85 | 30 | 29.0 | $>3 \times 10^8$ | Copper particles only in the first rinse water |
| Comparative 3 | 85 | 120 | 36.9 | 65, 110 160 | Copper particles only in the first rinse water |
| Example 1 | 90 | 10** | 46.9 | 1.64, 0.67 1.26, 0.97 | No copper particles in the rinse waters |
| Comparative 4 | 90 | 20 | | | Filaments fused together. Plating was not conducted. |

*Nitric acid contact time

**The acid pretreated yarn had Tensile (gpd)/Elongation (%)/Modulus(gpd) of 20.8/3.1/685.7, as compared with 24.0/3.2/699.7 for the non-treated yarn.

The copper pickup (expressed as weight percent of the plated fiber) and electrical resistance data, above, show that nitric acid at 20° C. is effective at concentrations greater than 85 weight percent for pretreating the fibers to promote copper plating. Nitric acid concentration of 85 weight percent is effective at slightly higher pretreatment temperatures up to about 50° C.; and 86 weight percent can be used effectively at 20° C. The Table, also, shows that a nitric acid pretreatment of adequate concentration and appropriate duration yields strongly adhered metal film as indicated by the lack of copper particles in visual inspection of the plating rinse waters. The presence of copper particles in the plating rinse waters is taken as indication of poor adhesion of the copper to the fiber substrate;—more particles indicating less adhesion.

COMPARATIVE EXAMPLE 5

The effect of phosphoric acid as a pretreatment acid was investigated in this example.

The same aramid yarn as was used in the previous examples was treated with about 87 W. % aqueous phosphoric acid for 60 seconds according to the method described in Example 1. The acid-treated yarn was neutralized, washed, knitted into small fabric tubings and copper-plated according to the methods described above. The fabric tubing picked up only 23.3% copper. The copper on the tubing was not homogeneously coated and the fabric exhibited an electrical resistance greater than $3\times10^8$ ohm per square. This example shows that pretreatment of aramid yarn with high concentration phosphoric acid does not promote copper plating as compared with the effects of pretreatment with about equal concentration of nitric acid.

EXAMPLES 2, 3 AND 4 AND COMPARATIVE EXAMPLES 6 AND 7

The effect of chlorosulfonic acid as a pretreatment acid was investigated in these examples.

The aramid yarn of previous examples was knitted into small fabric tubings according to the method described above; and the yarns were pretreated in that tubing form. Conditions for pretreatment of the tubings before copper plating are listed in Table 2. The data show that as low as 2 W. % chlorosulfonic acid ($ClSO_3H$) in any of methylene chloride, hexane, or cyclohexane exhibited a dramatic effect on copper pickup and electrical resistance. There were no copper particles in the rinse waters after plating when using the $ClSO_3H$ pretreatment.

TABLE 2

(Effect of Chlorosulfonic Acid Pretreatment On Plating)

| | Acid | Duration (sec) | Copper pickup (W %) | Elec. Res. (ohm/sq) |
|---|---|---|---|---|
| Example 2 | 2 W. % $ClSO_3H$/ 98 W % $CH_2Cl_2$ | 30 | 59.9 | 0.4, 0.3 0.4, 0.3, 0.3 |
| Comparative 6 | $CH_2Cl_2$ | 30 | 31.0 | $9 \times 10^6$ $>3 \times 10^8$ $>3 \times 10^8$ |
| Example 3 | 2 W % $ClSO_3H$/ 98 W % hexane | 40 | 49.6 | 0.4, 0.4 0.5, 0.4 |
| Comparative 7 | hexane | 40 | 31.0 | $>3 \times 10^8$ $>3 \times 10^8$ |
| Example 4 | 2 W % $ClSO_3H$/ 98 W % $C_6H_{12}$ | 20 | 44.0 | 1.2, 1.9, 1.5, 2.8 |

Chlorosulfonic acid can be used as an effective pretreatment at a concentration of as low as 1 weight percent acid in any organic liquid which is miscible but not reactive with the acid. The temperature of pretreatment is generally about 20° C. with activity increased by temperature increase, and the pretreatment duration is generally less than 60 seconds. At acid concentration greater than 5 weight percent, aramid fibers may be excessively damaged in tensile properties by pretreatment at too high a temperature or for too long a duration. Fluorosulfonic acid is used as a pretreatment in the same way and under the same conditions as chlorosulfonic acid.

COMPARATIVE EXAMPLE 8

The effect of hydrochloric acid as a pretreatment acid was investigated in this example.

The aramid yarn of previous examples was knitted into small fabric tubing according to the method described above. The yarns were pretreated in that tubing form with about 38 weight percent aqueous hydrochloric acid for 60 minutes at about 20° C. The acid-treated tubing was then neutralized, washed, air-dried, and copper plated according to the method described in Example 1. The fabric tubing copper pickup was only 26 weight percent, and the fabric exhibited an electrical resistance of greater than $3\times10^8$ ohms per square.

I claim:

1. In a process for electrolessly plating aramid fibers with a durable metal coating comprising the steps of contacting the fibers to be plated with an activation solution, rinsing the fibers, and immersing the fibers in a solution of metal cations to be plated;

the improvement which comprises, (a) contacting the aramid fibers with an acid liquid selected from the group consisting of, (i) 86 to 91 weight percent aqueous nitric acid, (ii) 1 to 5 weight percent chlorosulfonic acid in an organic liquid, and (iii) 1 to 5 weight percent fluorosulfonic acid in an organic liquid, for at least 2 seconds at a temperature in the range from 10° to 100° C.; and (b) washing the acid-contacted fibers with water until substantially all of the acid is removed, before contacting the fibers to be plated with the activation solution.

2. The process of claim 1 wherein the aramid fibers are contacted with the acid liquid for 2 to 120 seconds.

3. The process of claim 1 wherein there is the added step of:

(c) drying the washed fibers.

4. The process of claim 3 wherein the drying is conducted at 15°–25° C.

5. The process of claim 1 wherein the durable metal is copper.

6. The process of claim 5 wherein the activation solution is a tin-palladium solution.

7. The process of claim 1 wherein the durable metal is silver.

8. The process of claim 7 wherein the activation solution is a stannous solution.

9. A process for electrolessly plating aramid fibers with a durable metal coating comprising the steps of:

a) contacting aramid fibers with an acid liquid selected from the group consisting of, (i) 86 to 91 weight percent aqueous nitric acid, (ii) 1 to 5 weight percent chlorosulfonic acid in an organic liquid, and (iii) 1 to 5 weight percent fluorosulfonic acid in an organic liquid, for at least 2 seconds at a temperature in the range from 10° to 100° C.;

b) washing the acid-contacted fibers with water until substantially all of the acid is removed;

c) contacting the washed fibers with a catalyst solution;

d) rinsing the fibers to remove nonadherent catalyst; and e) immersing the rinsed fibers in an aqueous solution of metal cations to be plated.

10. The process of claim 9 wherein the aramid fibers are contacted with the acid liquid for 2 to 120 seconds.

11. The process of claim 9 wherein the metal cation to be plated is selected from the group consisting of silver, copper, nickel, and cobalt.

12. The process of claim 9 wherein there is the added step of:

drying the washed fibers after the washing of step (b) and before the contacting of step (c).

13. The process of claim 12 wherein the drying is conducted at 15°–25° C.

* * * * *